US006851127B1

(12) United States Patent
Khan

(10) Patent No.: US 6,851,127 B1
(45) Date of Patent: Feb. 8, 2005

(54) MULTIPURPOSE BLANKET

(76) Inventor: Avais Khan, 6121 E. Emory Rd., Knoxville, TN (US) 37938

( * ) Notice: Subject to any disclaimer, the term of this patent is extended or adjusted under 35 U.S.C. 154(b) by 0 days.

(21) Appl. No.: 10/644,301

(22) Filed: Aug. 20, 2003

(51) Int. Cl.[7] ..... A41D 15/04
(52) U.S. Cl. ..... 2/89; 2/84
(58) Field of Search ..... 2/69.5, 69, 84–89, 2/92–94, 108, 247, 456; 5/417, 482, 485, 413 R, 653

(56) References Cited

U.S. PATENT DOCUMENTS

| | | | | | |
|---|---|---|---|---|---|
| 2,659,086 | A | | 11/1953 | McGrath | |
| 3,798,676 | A | | 3/1974 | Shanks et al. | |
| 3,835,471 | A | | 9/1974 | Lankford | |
| 3,837,006 | A | * | 9/1974 | Laseman | 2/89 |
| 4,078,264 | A | | 3/1978 | DeGennaro et al. | |
| 4,752,971 | A | | 6/1988 | Meserol | |
| 5,414,881 | A | * | 5/1995 | Terrazas | 5/417 |
| 5,454,125 | A | * | 10/1995 | Ratkowski | 5/417 |
| 5,463,783 | A | * | 11/1995 | Pope | 5/417 |
| 5,588,749 | A | * | 12/1996 | Ishikawa | 383/4 |
| 5,875,492 | A | | 3/1999 | Moss | |
| 5,884,331 | A | | 3/1999 | Barajas | |
| 5,901,375 | A | | 5/1999 | Davis | |
| 5,924,132 | A | * | 7/1999 | Wigutow | 2/69 |
| 5,946,723 | A | | 9/1999 | DiPrato et al. | |
| 6,189,169 | B1 | * | 2/2001 | Marcotte | 5/655 |
| 6,243,873 | B1 | | 6/2001 | Aliff | |
| 6,275,993 | B1 | * | 8/2001 | McCarley | 2/84 |
| 6,353,933 | B1 | | 3/2002 | Love | |
| 6,367,083 | B1 | * | 4/2002 | November | 2/69.5 |
| 6,393,637 | B1 | * | 5/2002 | Hoffman | 5/413 R |
| 6,408,462 | B1 | * | 6/2002 | Moore | 5/417 |
| 6,643,870 | B2 | * | 11/2003 | Bertrand | 5/482 |
| 6,708,343 | B1 | * | 3/2004 | Ceron | 2/88 |
| 2004/0073985 | A1 | * | 4/2004 | Riccelli | 2/69 |

* cited by examiner

*Primary Examiner*—John J. Calvert
*Assistant Examiner*—Alissa L. Hoey
(74) *Attorney, Agent, or Firm*—Michael E. McKee

(57) ABSTRACT

A multi-purpose blanket which can be selectively folded into a compact condition for use as a seat cushion or placed into a spread condition for use as a protective covering includes a hood, a hood compartment, a pair of pockets, and an elongated storage pouch which is accessible to a user when the blanket is folded into a folded condition for use as a seat cushion. A strap is provided for securing the blanket in its folded condition, and a handle is secured to the storage pouch for enabling the blanket to be easily carried when secured in its folded condition. The pockets are disposed along the inner surface of the blanket to readily accept the hands of the user when the blanket is draped about the user for use as a protective covering, and closeable through-openings are provided within the blanket through which a user's hands and arms can extend when the blanket is draped about the user.

20 Claims, 4 Drawing Sheets

FIG. 1
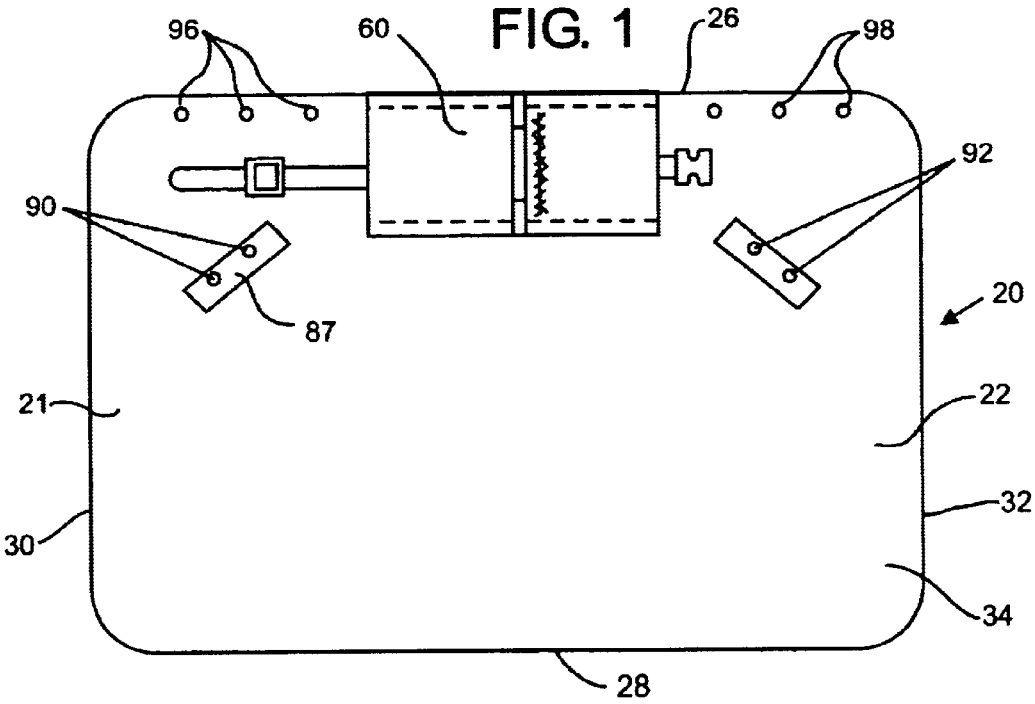
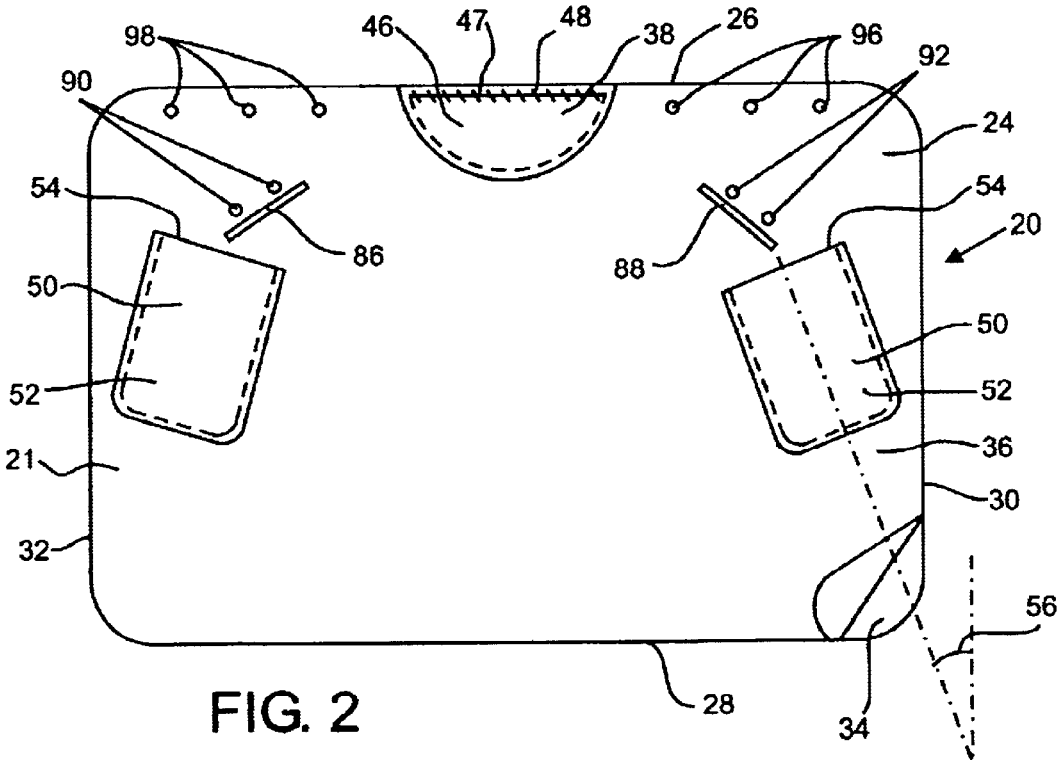
FIG. 2

MULTIPURPOSE BLANKET

BACKGROUND OF THE INVENTION

This invention relates generally to multi-purpose blankets and relates, more specifically, to a multi-purpose blanket which can be selectively used as a wrap-around protective covering, a lap blanket or a seat cushion.

The class of blanket with which this invention is to be compared include those which can be placed in a spread condition for use as a wrap-around covering or a lap blanket or folded to provide a seat cushion. When used as a wrap-around protective covering, the blanket is draped about the shoulders of the user, and when used as a lap blanket, the blanket is draped across the lap of the user. This class of blankets is particularly well-suited for use by a spectator in an outdoor sports venue, such as an open-air stadium, in which the spectator is normally exposed to the outdoor weather. Examples of blankets and related items in this class are shown and described in U.S. Pat. Nos. 3,798,676, 5,884,331, 5,901,375, and 3,798,676.

It is an object of the present invention to provide a new and improved blanket which can be selectively used as a wrap-around protective covering, a lap blanket or a seat cushion.

Another object of the present invention is to provide such a blanket which can be secured in a folded condition and which includes means enabling the blanket to be easily carried between sites.

Yet another object of the present invention is to provide such a blanket having a storage compartment which is readily accessible when the blanket is in a folded condition.

A further object of the present invention is to provide such a blanket which, when placed in a spread condition and positioned over a user, adequately protects the user from cold or inclement weather.

Still another object of the present invention is to provide such a blanket which is capable of being releasably secured in a wrapped condition about a user.

Yet still another object of the present invention is to provide such a blanket which is uncomplicated in construction yet effective in operation.

SUMMARY OF THE INVENTION

This invention resides in a multi-purpose blanket including a flexible planar body of substantially rectangular form having a top edge, a bottom edge which is substantially parallel to the top edge and two opposite and parallel side edges which are substantially perpendicular to and extend between the top and bottom edges, and defining an inner surface and an outer surface. The planar body is adapted to be folded into a relatively compact folded condition for use as a seat cushion or spread into a spread condition for use as a blanket or for use as a protective covering which can be draped about the user so that the inner surface surrounds and faces the torso of the user.

In addition, the blanket includes a hood compartment-forming member which is joined to the flexible planar body against the inner surface thereof so as to provide a hood compartment having an opening which is disposed adjacent the top edge of the planar body and which is positioned about midway along the length of the top edge. A hood is also provided which has a portion which is positioned within the opening of the hood compartment and which is secured to the inner surface of the planar body adjacent the top edge thereof so that the hood can be selectively tucked within the hood compartment for storage or withdrawn from the hood compartment for use.

Further still, a pair of pockets are associated with the inner surface of the planar body and are disposed adjacent the side edges thereof so that when the planar body is draped about the user so that the inner surface surrounds and faces the torso of the user, the pockets can accept the hands of the user. Furthermore, the pockets are disposed at an angle with respect to the side edges of the planar body so that when the planar body is draped about the user so that the inner surface surrounds and faces the torso of the user, each pocket opens inwardly of the side edges of the blanket, and the pockets are spaced from the top edge of the planar body by at least about eighteen inches.

An elongated storage pouch is joined to the outer surface of the planar body adjacent the top edge thereof so that when the planar body is folded into a folded condition for use as a seat cushion, the storage pouch is accessible. Moreover, at least one strap is joined to the planar body for securing the planar body in its folded condition, and a handle is secured to the planar body across the storage pouch for providing a grip with which the planar body can be carried when the planar body is secured in its folded condition.

BRIEF DESCRIPTION OF THE DRAWINGS

FIG. 1 is a plan view of one (i.e. the outer) side face of an embodiment of a blanket within which features of the present invention are incorporated and shown in a spread condition.

FIG. 2 is a plan view of the other (i.e. the inner) side face of the FIG. 1 embodiment, shown in a spread condition and having one of its material layers being folded back upon itself at a corner thereof.

DETAILED DESCRIPTION THE ILLUSTRATED EMBODIMENT

Figure 3:
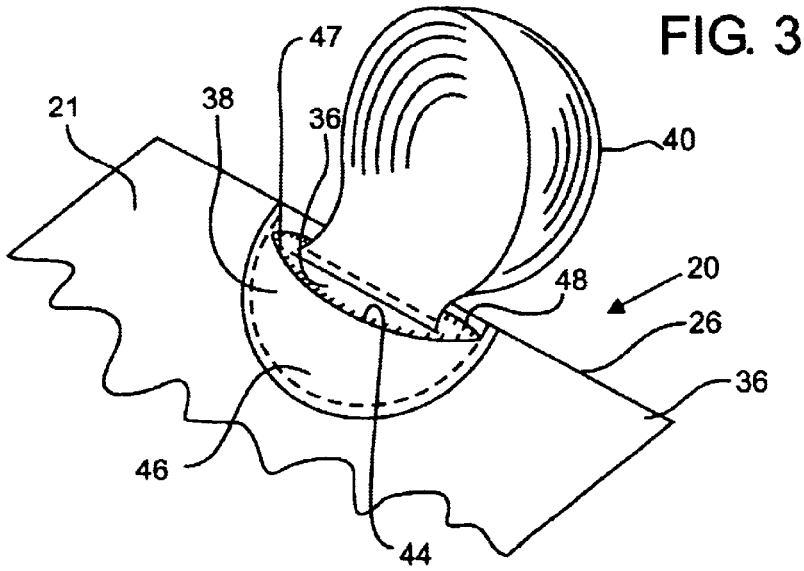
FIG. 3 is a fragmentary perspective view of the inner side face of the FIG. 1 blanket illustrating the hood and hood compartment thereof.

Turning now to the drawings in greater detail and considering first FIGS. 1 and 2, there is illustrated an embodiment, generally indicated 20, of a multi-purpose blanket which incorporates features of the present invention. As illustrated in its spread condition of FIGS. 1 and 2, the blanket 20 includes a substantially flexible planar body 21 which is relatively rectangular in form (with somewhat rounded corners) and which has two opposite side faces 22, 24 bordered by a top edge 26, a bottom edge 28 and two side edges 30, 32. As will be apparent herein and when the blanket 20 is draped about a user for use as a protective covering against the weather, the side face 22 provides the outer surface of the blanket 20 while the side face 24 provides the inner surface of the blanket 20.

The side faces 22, 24 of the planar body 21 are provided by two substantially rectangular pieces 34, 36 of material which are sewn together with stitches which extend along the top, bottom and side edges thereof and which are quilted together with stitches which extend across the surfaces 22, 24 thereof. To enhance the warmth of the planar body 21, a third layer of material (e.g. batting) is sandwiched (and sewn) between the material pieces 34, 36 with the quilting stitches thereof. In addition and in order to render the outer side face 22 substantially water-repellant, it is preferable that the (outer) material piece 34 is comprised of water-resistent material, such as Nylon.

To enable the blanket 20 to be secured in a wrapped condition about the torso of a user (so that the inner surface 24 of the planar body surrounds and faces the user's torso), there are provided snap fasteners including mating members 96 and 98 which are secured along the top edge 26 of the planar body 21, as illustrated in FIG. 2. It follows that these snap fasteners provide means for releasably securing the planar body 21 in a draped condition about the user so that the weight of the blanket 20 is supported by the shoulders of the user.

With reference to FIGS. 2 and 3, there is associated with the inner surface 24 of the planar body 21 a hood compartment 38 and a hood 40 which are situated along the top edge 26 of the planar body 21. The hood compartment 38 is comprised, in part, of a semi-circular hood compartment-forming material piece 46 having a substantially linear opening 47 which extends generally along the straight edge thereof and which is sewn to the (inner) material piece 36 at a location situated about midway between the side edges 30 and 32 of the planar body 21 so that the opening 47 extends along the top edge 26. Thus, the hood compartment 38 is provided by the pocket, indicated 44 in FIG. 3, formed between the opposing surfaces of the material pieces 46 and 36 and which is accessible through the opening 47. The opening 47 can be selectively opened or closed by way of a zipper 48 which is sewn along the border of the opening 47.

The hood 40 is shaped to substantially conform to the shape of the back of a human head and is sewn along its lower edge (as viewed in FIG. 3) to the inner surface 24 of the blanket 20 and inside of the pocket 44 of the hood compartment 38. The hood 40 is provided by a piece of flexible material which can be selectively folded up (i.e. tucked) and entirely positioned within the pocket 44 of the compartment 38 through the opening 47 thereof so as to be substantially hidden from view or unfolded through the opening 47 the zipper 48 for use as a hood. When pulled out of the pocket 44 of the compartment 38 for use, the hood 40 can be unfolded so as to extend above the top edge 26 thereof, as shown in FIG. 3.

With reference again to FIG. 2, the blanket 20 further includes a pair of pockets 50 which are accessible to the hands of a user when the blanket 20 is worn as a protective covering, and thus wrapped about the torso of a user. In this connection, each pocket 50 is comprised, in part, of a piece 52 of flexible material which is sewn along its side and bottom edges (as viewed in FIG. 2) to the material of the inner surface 24 and so that the resultant opening, indicated 54, of the pocket 50 opens somewhat toward the hood compartment 38 when the blanket 20 is positioned in its illustrated FIG. 2 spread condition. Preferably, each pocket 50 (or its opening thereof) is canted with respect to the corresponding side edge 30 or 32 of the blanket 20 so that the pocket opening 54 opens inwardly of the side edges of the blanket 20 at an angle 56 (FIG. 2) of between about twenty and thirty degrees (and optimally about twenty-five degrees) with respect to the corresponding side edge 30 or 32 of the blanket 20 to enhance the accessibility of the pockets 50 to the hands of the user, when the blanket 20 is worn (e.g. across the user's shoulders) as a protective covering. In addition, each pocket opening 50 is spaced at least about eighteen inches from the top edge 26 of the blanket 20 so that when the blanket 20 is draped about the shoulders of a user for use as a protective covering, the pockets 50 are disposed at a convenient height for accepting the hands of the user.

Figure 4:
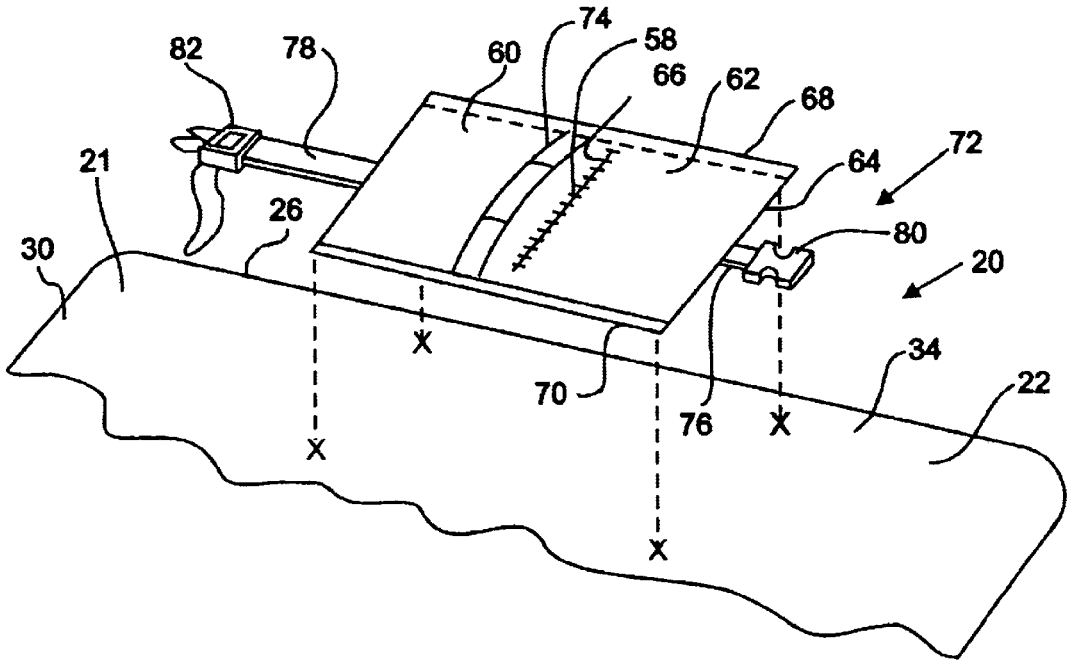
FIG. 4 is a fragmentary perspective view of the outer side face of the FIG. 1 blanket illustrating the storage pocket thereof.

With reference to FIGS. 1 and 4, there is associated with the outer surface 22 of the planar body 21 a substantially rectangular storage pouch 60 which is accessible to a user when the blanket 20 is placed in its folded condition. The storage pouch 60 includes a pair of rectangular pieces 62, 64 of material which are sewn together along each of its four edges and includes a linear opening 58 bordered by a zipper 66 which extends transversely across the material piece 62 of the pouch 60. It follows that access can be had to the interior of the pouch 60 through the opening 58 by opening the zipper 66.

In order that the storage pouch 60 is accessible to a user in the manner intended, the pouch 60 is sewn to the outer surface 22 adjacent the upper edge 26 thereof and at a location disposed medially along the length of the upper edge 26. Rather than being sewn to the outer surface 22 around the entirety of the edges of the pocket 60, the pouch 60 is sewn to the outer surface 22 only along its opposite upper and lower edges, indicated 68 and 70 in FIG. 4. With the pouch 60 sewn to the outer surface 22 in this manner, the pouch 60 is permitted to expand as necessary to accommodate a large quantity of items placed therein.

Figure 13:
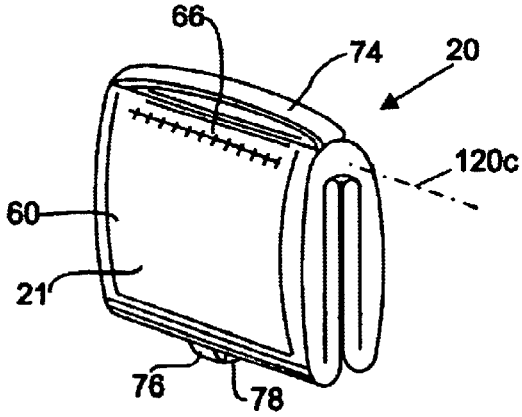
FIG. 13 is a perspective view of the FIG. 1 blanket, shown completely folded together for use as a seat cushion and prepared to be carried with its handle.

The blanket 20 further includes strap means, generally indicated 72 in FIG. 4, for securing the blanket 20 in a folded condition and a handle 74 with which the blanket 20 can be manually carried between sites. In the depicted embodiment 20, the strap means 72 includes a pair of fabric strips 76, 78 which are each sewn at one end to a corresponding side edge of the pouch 60 and one of a set of mating buckle members 80, 82 which are secured to the fabric strips 76, 78, as shown in FIG. 4. The fabric strips 76, 78 are of such length and the buckle members 80, 82 are disposed along the length of the strips 80, 82 so that when the blanket 20 is folded up to its folded condition (such as is illustrated in FIG. 13), the strips 76, 78 can be pulled toward one another around the blanket 20 and can be buckled together with the buckle members 80, 82 to secure the blanket 20 in its folded condition.

The handle 74 is in the form of a strap of fabric having two opposite ends which are each sewn, or stitched, to a corresponding upper edge 68 or lower edge 70 of the pouch 60. Just as the pocket 60 is accessible to a user when the blanket 20 is positioned in a folded condition, the handle 74 is accessible to a user, as well.

With reference again to FIGS. 1 and 2, the blanket 20 also includes a pair of linear through-openings, or slits 86 and 88, which are disposed adjacent the pockets 50 and which are bordered by a set of snap fasteners 90 and 92 for releasably securing the through-openings 86 and 88 in a closed condition. The slits 86, 88 are each disposed between the top edge 26 and the opening 54 of a corresponding pocket 50 and are each about one foot in length. When opened, each of the slits 86 or 88 permits a corresponding one of the user's arms and hands to extend through the sides of the planar body 21 while the blanket 20 remains wrapped around the user (e.g. across the user's shoulders) as a protective covering. Such a feature can be readily appreciated when the user needs to grasp onto a hand rail as he walks up or down stadium steps while the blanket 20 remains wrapped about the user's torso. To help prevent the passage of water (e.g. rainwater) from the outer surface 22 of the blanket 20 through the slits 86 and 88, a flap 87 (FIG. 1) is sewn adjacent for covering the slit 86 or 88.

Figure 5:
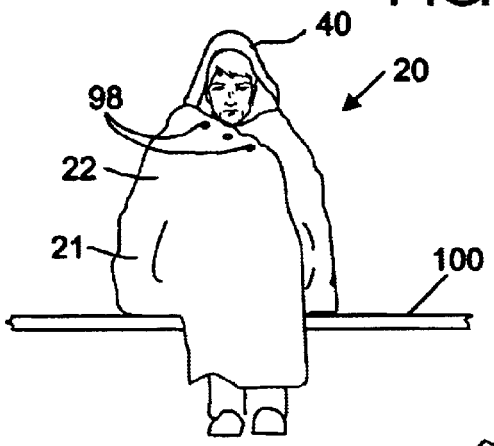
FIG. 5 is a front elevational view of a user wearing the blanket of FIG. 1 as a protective covering.

To use the blanket 20 as a protective covering and with reference to FIG. 5, the planar body 21 of the blanket 20 is arranged in its spread condition and draped across the back and shoulders of the user so that the hood compartment 38 is positioned directly behind the user's neck. With the planar body 21 of the blanket 20 supported across the user's shoulders in this manner, the side edges 30 and 32 are pulled across the front of the user and secured together with the snap fastener members 96, 98. If desired, the hood 40 (FIG. 3) can be withdrawn from the hood compartment 38 and positioned about the user's head as is illustrated in FIG. 5. Although the user is shown seated upon a bench, indicated 100 in FIG. 5, it is preferred that before being seated, the user initially assume a standing position in order to more easily wrap the blanket 20 about the user's torso. In addition and if the user desires to walk while the blanket 20 remains wrapped about him in this manner, the snap fasteners 90 and 92 (FIG. 2) can be unfastened to permit the arms and hands to extend through the slits 86, 88.

Figure 6:
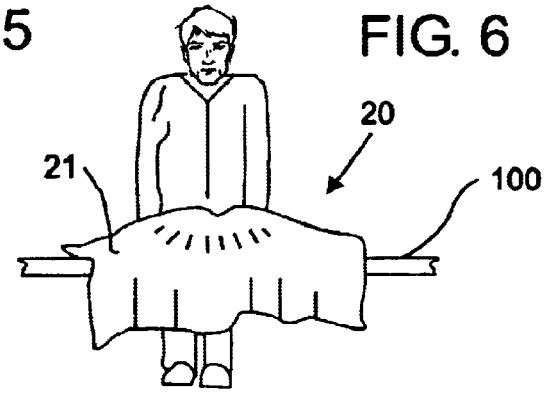
FIG. 6 is a front elevational view of a user utilizing the blanket of FIG. 1 as a lap blanket.

To use the blanket 20 as a lap blanket and with reference to FIG. 6, the planar body 21 of the blanket 20 is simply positioned in its spread condition and draped across the lap of the user (while the user remains seated upon the bench 100) so that the user's lap, and legs are covered, as is illustrated in FIG. 6. If desired, the planar body 21 of the blanket 20 can be folded back upon itself (e.g. in half) to reduce the area of the user's lap and legs to be covered by the blanket 20.

Figure 7:
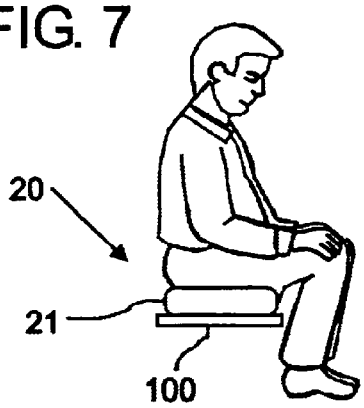
FIG. 7 is a side elevational view of a user utilizing the blanket of FIG. 1 as a seat cushion.

To use the blanket 20 as a seat cushion and with reference to FIG. 7, the planar body 21 is folded up into a relatively compact unit, in a manner demonstrated herein, and placed upon the bench 100. The blanket 20 can then be sat upon, as is illustrated in FIG. 7.

Figure 8:
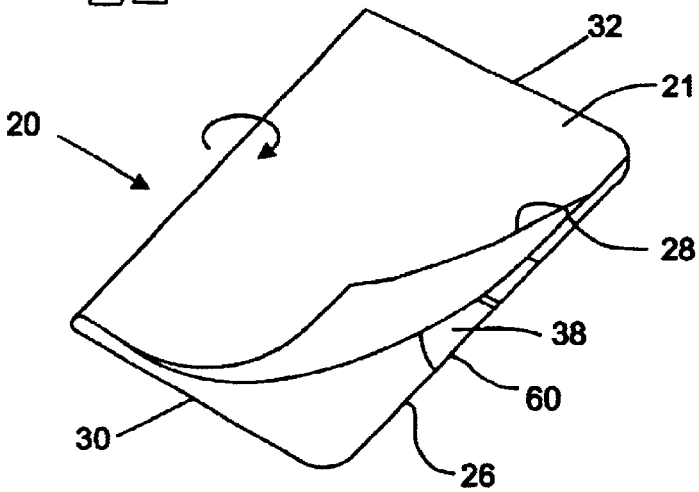
FIGS. 8–12 are perspective views illustrating the steps involved in folding the blanket of FIG. 1 from a spread condition into a folded condition.
Figure 9:
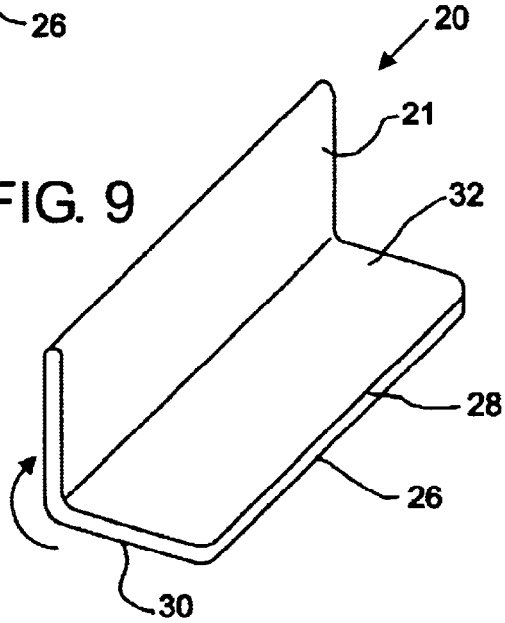

To fold the blanket 20 into a relatively compact unit from the spread condition of FIG. 1 or 2, the planar body 21 is initially folded in half as illustrated in FIG. 8 so that the side edges 30, 32 are folded in half and the bottom edge 28 is positioned directly over the top edge 26. With the blanket 20 arranged in this manner, the storage pouch 60 is positioned on the underside of the planar body 21 so as to face the underlying floor. The blanket 21 is then folded in half again, as illustrated in FIG. 9, along a fold line which is generally parallel to the top and bottom edges 26 and 28 and so that the storage pouch 60 remains positioned on the underside of the planar body 21 so as to face the underlying floor.

Figure 10:
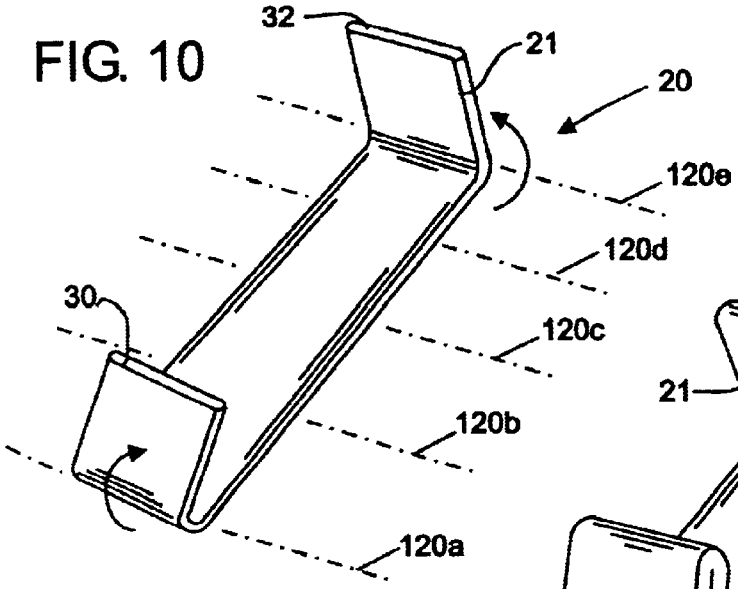
Figure 11:
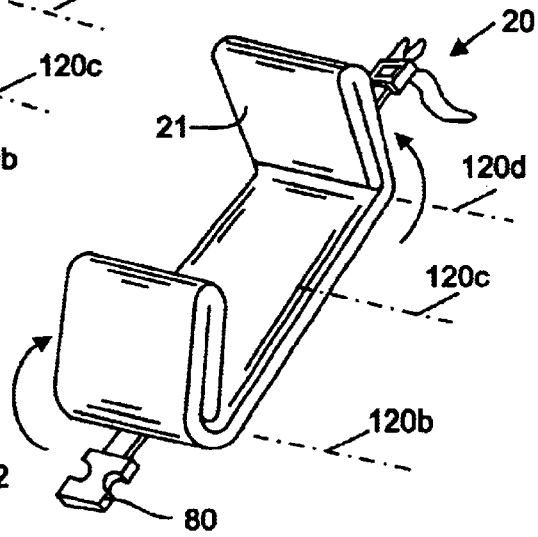
Figure 12:
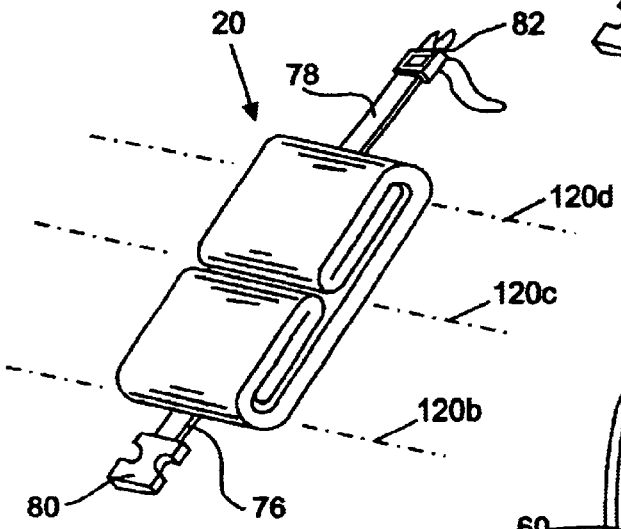

While the blanket 20 remains arranged so that its pouch 60 faces downwardly, the opposite ends (i.e. the edges 30 and 32) of the blanket are pulled toward the middle thereof so that each of the opposite end portions of the blanket 20 is folded back upon itself. More specifically, beginning at the opposite ends of the blanket 20, the blanket is folded toward the middle thereof along fold lines, indicated 120*a*–120*e* in FIGS. 10 and 11, so that the blanket 20 is effectively folded into six sections. For example, there is illustrated in FIG. 10 the opposite ends of the blanket 20 being folded toward the middle along fold lines 120*a* and 120*e*, respectively, and there is illustrated in FIG. 11 the previously-folded (end) sections of the blankets 20 being folded toward the middle thereof along the fold lines 120*b* and 120*d*, respectively, to form the arrangement illustrated in FIG. 12. The blanket 20 is then folded along the (center) fold line 120*c* to position the opposite ends of the storage pouch 60 together, as illustrated in FIG. 13. At that point, the straps 76, 78 (by way of the buckle members 80, 82) can be connected to one another around the blanket 20 to secure the blanket 20 in its relatively compact, rectangular arrangement of FIG. 13. Since the handle 74 is positioned along the edge of the folded blanket 20 opposite the buckled straps 76, 78, as illustrated in FIG. 13, the blanket 20 can be easily carried between sites with the handle 74.

Exemplary dimensions of the blanket 20 are provided here as follows: Each of the top and bottom edges of the planar body 21 of the blanket 20 is about seventy-five inches in length, each of the side edges of the planar body 21 is about fifty-nine inches in length, each pocket 50 is about nine inches wide and about seventeen inches in depth, the opening 47 of the hood compartment 38 is about nineteen inches in length, the elongated storage pouch 60 measures about fourteen inches (along its shortest edges) by about twenty-three inches, and the opening 58 of the storage pouch 60 is disposed about ten inches from the closest end of the pouch 60.

It will be understood that numerous modifications and substitutions can be had to the aforedescribed embodiment 20 without departing from the spirit of the invention. For example, although the aforedescribed embodiment 20 has been shown and described as including snap fastener members 96, 98 to secure the top edge 26 in a secured and overlapping condition about the user's shoulders, hook and loop fasteners, such as are available in the trade under the designation Velcro, can be substituted for the snap fastener members 96, 98. Accordingly, the aforedescribed embodiment 20 is intended for the purpose of illustration and not as limitation.

What is claimed is:

1. A multi-purpose blanket comprising:

a flexible planar body of substantially rectangular form having a top edge, a bottom edge which is substantially parallel to the top edge and two opposite and parallel side edges which are substantially perpendicular to and extend between the top and bottom edges, and defining an inner surface and an outer surface, the planar body adapted to be folded into a relatively compact folded condition for use as a seat cushion or spread into a spread condition for use as a blanket or for use as a protective covering which can be draped about the user so that the inner surface surrounds and faces the torso of the user;

a hood compartment-forming member which is joined to the flexible planar body against the inner surface thereof so as to provide a hood compartment having an opening which is disposed adjacent the top edge of the planar body and which is positioned about midway along the length of the top edge;

a hood having a portion which is positioned within the opening of the hood compartment and which is secured to the inner surface of the planar body adjacent the top edge thereof so that the hood can be selectively tucked within the hood compartment for storage or withdrawn from the hood compartment for use;

a pair of pockets associated with the inner surface of the planar body and disposed adjacent the side edges thereof so that when the planar body is draped about the user so that the inner surface surrounds and faces the torso of the user, the pockets can accept the hands of the user, the pockets being disposed at an angle with respect to the side edges of the planar body so that when the planar body is draped about the user so that the inner surface surrounds and faces the torso of the user, each pocket opens inwardly of the side edges of the blanket, and the pockets are spaced from the top edge of the planar body by at least about eighteen inches;

an elongated storage pouch joined to the outer surface of the planar body adjacent the top edge thereof so that when the planar body is folded into a folded condition for use as a seat cushion, the storage pouch is accessible;

at least one strap which is joined to the planar body for securing the planar body in its folded condition; and a handle which is secured to the planar body across the storage pouch for providing a grip with which the planar body can be carried when the planar body is secured in its folded condition.

2. The blanket as defined in claim 1 further including means for releasably securing the planar body about the user when the planar body is draped about the user.

3. The blanket as defined in claim 2 wherein the means for releasably securing includes snap fasteners having mating members which are attached to the planar body along the top edge thereof so that when the planar body is draped about the user so that the inner surface surrounds the torso of the user, the mating members can be snapped together to releasably secure the planar body about the shoulders of the user.

4. The blanket as defined in claim 1 wherein the hood compartment-forming member and further includes a zipper for selectively opening and closing the hood compartment opening.

5. The blanket as defined in claim 1 wherein the planar body includes one material piece which provides the inner surface of the planar body and another material piece which provides the outer surface of the planar body.

6. The blanket as defined in claim 5 wherein the another piece of material is comprised of a water-repellant material.

7. The blanket as defined in claim 5 further including a third layer of material which is sandwiched between the one and the another material pieces.

8. The blanket as defined in claim 1 wherein the elongated storage pouch is substantially rectangular in form so as to define four edges, and the pouch is sewn to the outer surface of the planar body along only two of the opposite ones of its four edges to accommodate expansion of the pouch.

9. The blanket as defined in claim 1 wherein the pouch has an opening which is oriented substantially parallel to the side edges of the planar body, and the pouch further includes a zipper for selectively opening and closing the pouch opening.

10. The blanket as defined in claim 1 wherein the planar portion defines a pair of closeable through-openings disposed adjacent the pockets through which a user's hands and arms can extend when the blanket is draped about the user.

11. A multi-purpose blanket which can be selectively positioned across the lap of or wrapped about a user for protection against the weather or used as a seat cushion, the blanket comprising:

a flexible planar rectangular body having a top edge, a pair of opposite and parallel side edges which extend downwardly from the top edge, and a bottom edge which is parallel to the top edge and which extends between the two side edges, and the planar body defines an inner surface and an outer surface and is adapted to be selectively placed in a spread condition for use as a blanket or as a protective covering which can be wrapped about the user for protection against the weather as the inner surface surrounds and faces the torso of the user or folded into a relatively compact folded condition for use as a seat cushion;

a semi-circular piece of material which is joined to the inner surface of the planar body adjacent the top edge thereof at a location situated substantially midway between the side edges thereof so that the semi-circular piece of material forms with the inner surface a hood compartment having an opening which extends along and is disposed adjacent the top edge thereof;

a hood having a portion which is positioned within the hood compartment and which is secured to the inner surface of the planar body adjacent the top edge thereof so that the hood can be selectively tucked within the hood compartment for storage or withdrawn from the hood compartment for use;

a pair of pocket-forming pieces which are joined to the inner surface of the planar body and adjacent the side edges thereof to form a pair of pockets thereat so that when the planar body is wrapped around the user for protection against the weather so that the inner surface surrounds and faces the torso of the user, the pockets can accept the hands of the user, the pockets being disposed at an angle of between about twenty and thirty degrees with respect to the side edges of the planar body so that each pocket opens inwardly of the side edges of the blanket, and the pockets being spaced from the top edge of the planar body by at least about eighteen inches;

an elongated storage pouch joined to the outer surface of the planar body adjacent the top edge thereof so that when the planar body is folded into a folded condition for use as a seat cushion, the storage pouch is accessible;

at least one strap which is joined to the planar body for securing the planar body in its folded condition; and a handle which is secured to the planar body across the storage pouch for providing a grip with which the planar body can be carried when the planar body is secured in its folded condition.

12. The blanket as defined in claim 11 further including means for releasably securing the planar body about the user when the planar body is draped about the user.

13. The blanket as defined in claim 12 wherein the means for releasably securing includes snap fasteners having mating members which are attached to the planar body along the top edge thereof so that when the planar body is draped about the user so that the inner surface surrounds the torso of the user, the mating members can be snapped together to releasably secure the planar body about the shoulders of the user.

14. The blanket as defined in claim 11 wherein the hood compartment-forming member further includes a zipper for selectively opening and closing the hood compartment opening.

15. The blanket as defined in claim 11 wherein the planar body includes one material piece which provides the inner surface of the planar body and another material piece which provides the outer surface of the planar body.

16. The blanket as defined in claim 15 wherein the another piece of material is comprised of a water-repellant material.

17. The blanket as defined in claim 11 wherein the elongated storage pouch is substantially rectangular in form so as to define four edges, and the pouch is sewn to the outer surface of the planar body along only two of the opposite ones of its four edges to accommodate expansion of the pouch.

18. The blanket as defined in claim 11 wherein the pouch has an opening which is oriented substantially parallel to the side edges of the planar body, and the pouch further includes a zipper for selectively opening and closing the pouch opening.

19. The blanket as defined in claim 11 wherein the planar portion defines a pair of closeable through-openings disposed adjacent the pockets through which a user's hands and arms can extend when the planar body is wrapped around the user for protection against the weather.

20. The blanket as defined in claim 19 further including a pair of flaps attached to the outer surface of the planar body for covering the through-openings and thereby preventing the passage of water therethrough from the outer surface of the planar body.

* * * * *